US005955962A

United States Patent [19]

Matsuura

[11] Patent Number: 5,955,962

[45] Date of Patent: Sep. 21, 1999

[54] RADIO SELECTIVE CALLING RECEIVER

[75] Inventor: Tatsuya Matsuura, Shizuoka, Japan

[73] Assignee: NEC Corporation, Tokyo, Japan

[21] Appl. No.: 08/888,092

[22] Filed: Jul. 3, 1997

[30] Foreign Application Priority Data

Jul. 8, 1996 [JP] Japan ..... 8-178274

[51] Int. Cl.[6] ..... G08B 5/22

[52] U.S. Cl. ..... 340/825.44; 455/38.1; 340/825.69; 340/825.72; 340/825.04

[58] Field of Search ..... 340/825.44, 825.03, 340/825.54, 825.04, 825.07, 825.69, 825.21, 825.3, 825.72, 825.22; 455/38.1

[56] References Cited

U.S. PATENT DOCUMENTS 4,872,005 10/1989 DeLuca et al. ..... 340/825.44

FOREIGN PATENT DOCUMENTS 4-304039 10/1992 Japan .

*Primary Examiner*—Michael Horabik
*Assistant Examiner*—Anthony A. Asongwed
*Attorney, Agent, or Firm*—Young & Thompson

[57] ABSTRACT

In a radio selective calling receiver, a controller automatically writes time information and message information included in a received paging signal in a storage thereof if a particular code is included in the paging signal. If the particular code is absent from the paging signal, the controller urges the user of the receiver to decide whether or not the time information and message information should be written to the storage and should be reported on the date and hour designated by the time information.

3 Claims, 4 Drawing Sheets

| PARTICULAR CODE | TIME INFORMATION | MESSAGE INFORMATION |
|---|---|---|

Fig. 4

| | |
|---|---|
| Jan,31 15:00 | Meeting |
| Input Schedule | <YES NO> |

Fig. 5

| | |
|---|---|
| Jan,31 15:00 | Meeting |
| Schedule | |

Fig. 6

RADIO SELECTIVE CALLING RECEIVER

BACKGROUND OF THE INVENTION

1. Field of the Invention

The present invention relates to a radio selective calling receiver and, more particularly, to a radio selective calling receiver capable of reporting a message meant for the receiver at a time indicated by time information which is included in a paging signal.

2. Description of the Related Art

Referring to FIG. 1 of the drawings, a conventional radio selective calling receiver taught in, e.g., Japanese Patent Laid-Open Publication No. 4-304039 is shown. As shown, the receiver includes an antenna 1 and an RF (Radio Frequency) or radio section 2. The RF 2 demodulates a paging signal coming in through the antenna 1 and feeds the demodulated paging signal to a wave shaper 3. The wave shaper 3 transforms the input signal to a corresponding digital signal. A decoder decodes an address signal included in the digital signal and compares the resulting address number with an address number assigned to the receiver and stored in an ID (identification) memory 5. When the two address numbers are identical, the decoder 4 delivers to a microprocessor or CPU (Central Processing Unit) 6 a signal indicative of the receipt of a call meant for the receiver. In response, the CPU 6 feeds a control signal to a driver 7 for alerting the user of the pager to the incoming call. Further, the CPU 6 delivers a control signal to an LCD (Liquid Crystal Display) driver 9. In response, the LCD driver 9 drives an LCD 9 in order to display a received message thereon. The received message is written to a memory 10, so that it can be again displayed on the LCD 9 later, as needed. The driver 7 drives an LED (Light Emitting Diode) 11 and a speaker 12 for the purpose mentioned above.

The above receiver additionally plays the role of an electronic pocketbook. When the user inputs a desired time and desired information on keyboard switches 13, they are written to the memory 10 under the control of the CPU 6. The information stored in the memory 10 can be displayed on the LCD 9 when searched for via the keyboard switches 13 or under the control of the LCD driver 8.

Further, assume that the received message includes bracketed information. Then, the CPU 6 determines the bracketed information to be indicative of a time and searches the memory 10 to see if information scheduled on that time, i.e., date and hour exists in the memory 10 or not. If the scheduled information exists in the memory 10, the CPU 6 causes the speaker 12 to sound at a frequency and period different from those assigned to an ordinary alert via the driver 7. At the same time, the CPU 6 causes a preselected mark to appear on the LCD 9 via the driver 7, informing the user of the fact that scheduled information has already been registered at the same time. If no scheduled information have been registered at the above time, the CPU 6 causes the speaker 12 to sound at the ordinary frequency and period designated by the ID memory 5 via the driver 7. At the same time, the CPU 6 causes another preselected mark to appear on the LCD 9, informing the user of the above fact. Then, the CPU 6 writes the content of the received message other than the bracketed information in the memory 10 and causes still another mark to appear on the LCD 9, showing the user that the message has been registered as a scheduler.

The conventional receiver with the above construction has a problem that when the received paging signal includes time information, the message information is written to the memory 10 without regard to the degree of importance of the information. Specifically, even information not important for the user are written to the memory 10, obstructing the efficient use of the memory 10. Another problem is that if the user forgets the registered data, registering the message information is practically meaningless.

SUMMARY OF THE INVENTION

It is therefore an object of the present invention to provide a radio selective calling receiver free from the above problems and a method of controlling the same.

It is another object of the present invention to provide a radio selective calling receiver capable of urging the user of the receiver to decide, depending on the degree of importance of time information and message information, whether or not to automatically input such information in a scheduler, thereby promoting the efficient use of a storage for storing messages.

In order to achieve the above object, a radio selective calling receiver of the present invention includes a controller which automatically stores, when a received paging signal includes a particular code in addition to time information and message information, the time information and message information in a storage thereof. However, when the paging signal does not include the particular code, the controller urges the user of the receiver to decide whether or not the time information and message information should be stored in the storage, and whether or not a reporting operation should be effected on the date and hour indicated by the time information.

The controller should preferably include a scheduler input request code detecting section for detecting the particular code out of the paging signal.

An arrangement should preferably made such that when the paging signal includes the time information and message information, but does not include the particular code, and if the user decides that the time information and message information should not be stored in the storage as scheduler information, the controller stores the time information and message information as a usual message signal.

In accordance with a method of controlling a radio selective calling receiver of the present invention, if a paging signal sent from a calling station to the receiver includes a particular code in addition to time information and message information, the time information and message information are automatically stored in a storage included in the receiver. If the paging signal does not include the particular code, the user of the receiver is urged to decide whether or not the time information and message information should be stored in storage and should be reported on the date and hour designated by the time information.

BRIEF DESCRIPTION OF THE DRAWINGS

These and other objects, features and advantages of the present invention will become more fully apparent from the following detailed description taken with the accompanying drawings in which:

FIG. 4 shows a specific data structure applicable to the embodiment and including a particular code, time information, and message information; and FIGS. 5 and 6 each shows particular time information and particular message information to be displayed in the embodiment.

In the drawings, the same reference numerals denote the same structural elements.

DESCRIPTION OF THE PREFERRED EMBODIMENT

Figure 1:
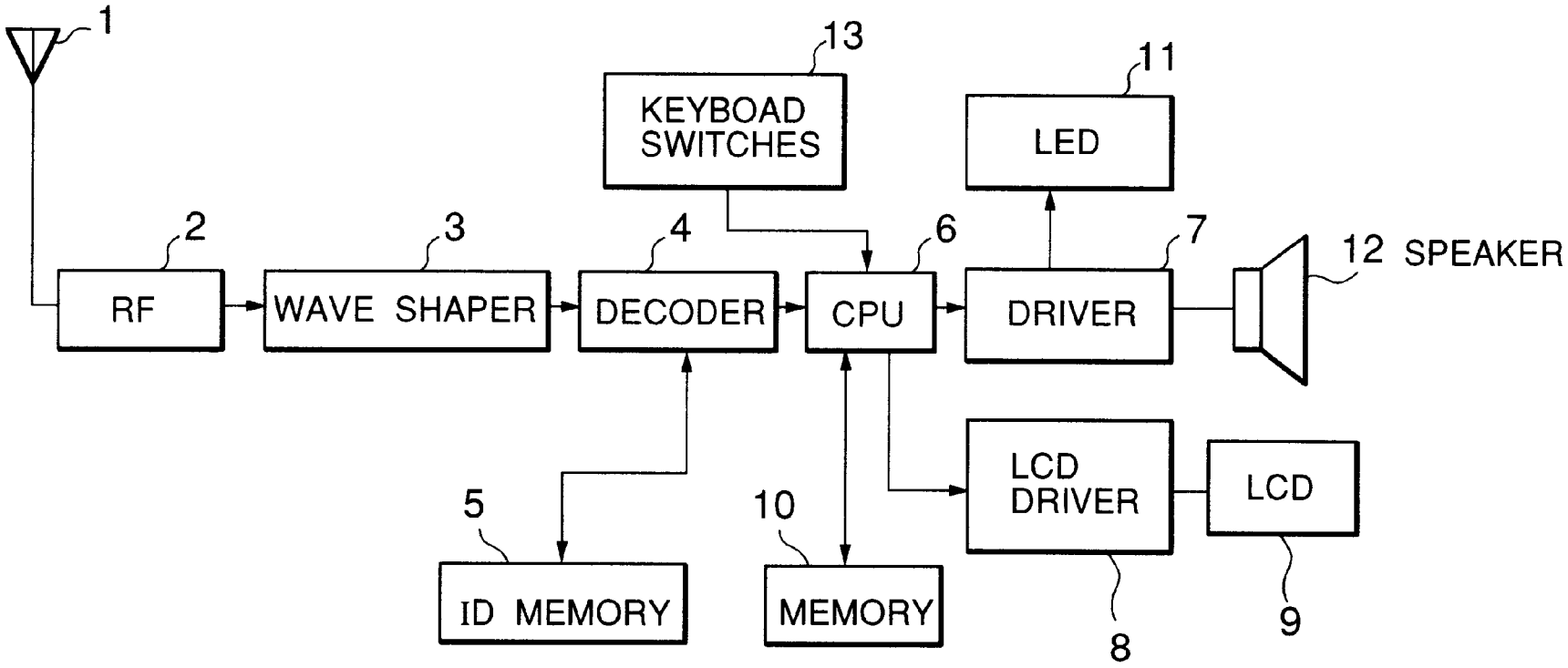
Fig. 1 PRIOR ART
FIG. 1 is a block diagram schematically showing a conventional radio selective calling receiver.
Figure 2:
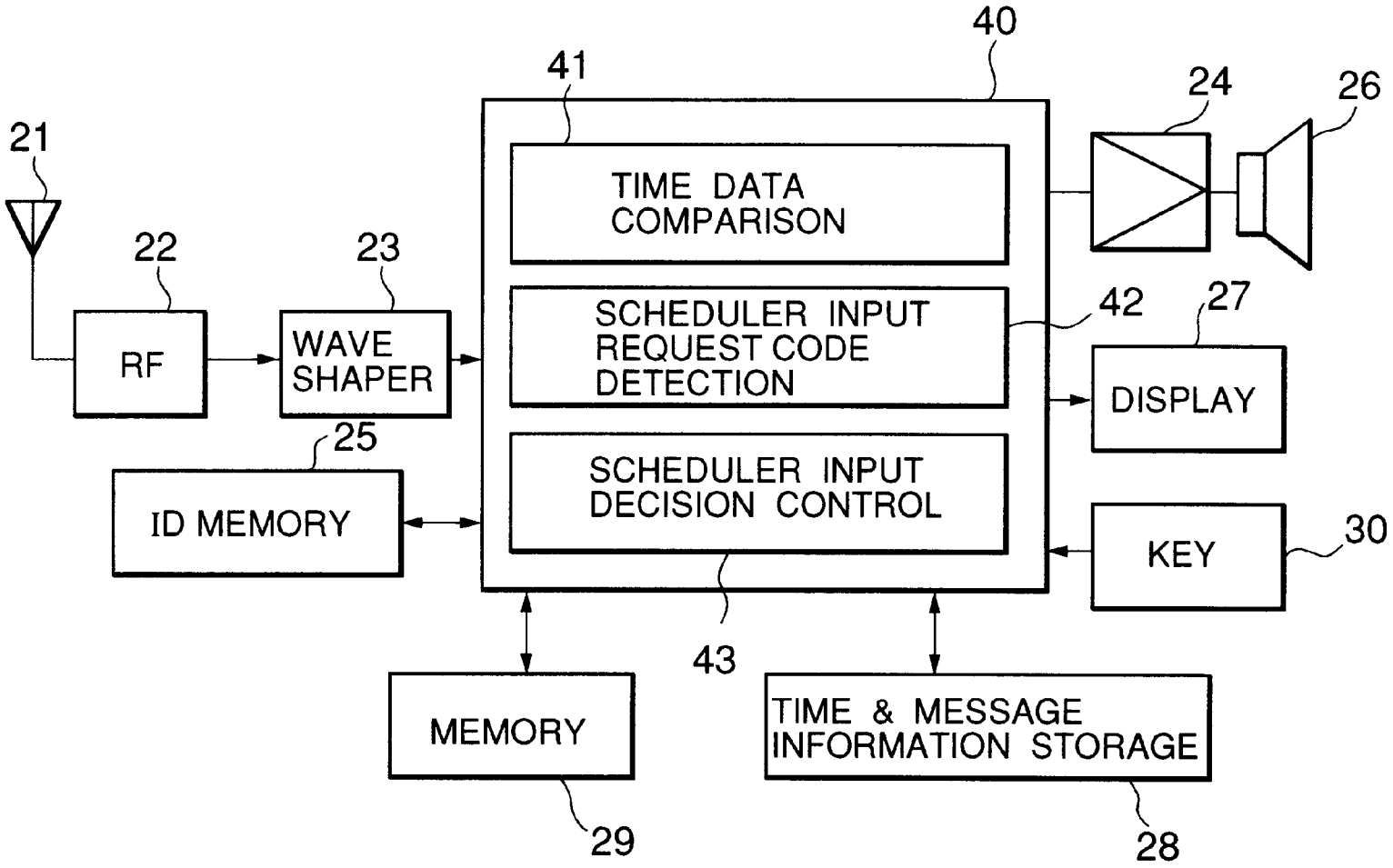
FIG. 2 is a schematic block diagram showing a radio selective calling receiver embodying the present invention.

Reference will be made to FIG. 2 for describing a radio selective calling receiver embodying the present invention. As shown, the receiver includes an antenna 21 and an RF 22 for amplifying and demodulating a paging signal coming in through the antenna 21. A wave shaper 23 transforms the demodulated signal output from the RF 22 to a digital signal which a controller 40 can read. The controller 40 is made up of a time information comparison 41, a scheduler input request code detection 42, and a scheduler input decision control 43. The time information comparison 41 compares an address signal included in the digital signal output from the wave shaper 23 with an address number assigned to the receiver and stored in an ID memory 25. If the address signal and address number are identical, the controller 40 delivers an alert signal to an amplifier 24 so as to inform the user of the receiver of the receipt of a call.

The amplifier 24 amplifies the input alert signal and feeds its output to a speaker 26. In response, the speaker 26 produces an alert tone in order to report the incoming call to the user. The controller 40 analyzes a message signal following the address signal and causes an LCD or similar display 27 to display a message represented by the message signal. When the received paging signal includes time information and message information, the scheduler input request code detection 42 determines whether or not a particular code, e.g., "*#" is present.

When the above particular code is present, as determined by the detection 42, the controller 40 writes the time information and message information in a time and message storage 28. The comparison 41 compares the time information stored in the storage 28 with the current time being counted by a time counter, not shown, built in the receiver. When the current time coincides with the time information, the controller 40 causes the message information to appear on the display 27 while effecting an alerting operation.

Assume that the particular code "*#" is absent in the received paging signal, as determined by the detection 42. Then, the controller 40 causes the scheduler input decision control 43 to urge the user of the receiver to decide whether or not the time information and message information should be written to the storage 28 and should be displayed on the date and hour indicated by the time information. At this instant, a message for urging the user to make such a decision appears on the display 27.

Additionally shown in FIG. 2 are a memory (M-RAM) for writing signal data to be processed by the controller 40 temporarily therein and reading them out, and a key 30 to be operated for inputting a display command meant for the display 27.

Figure 3:
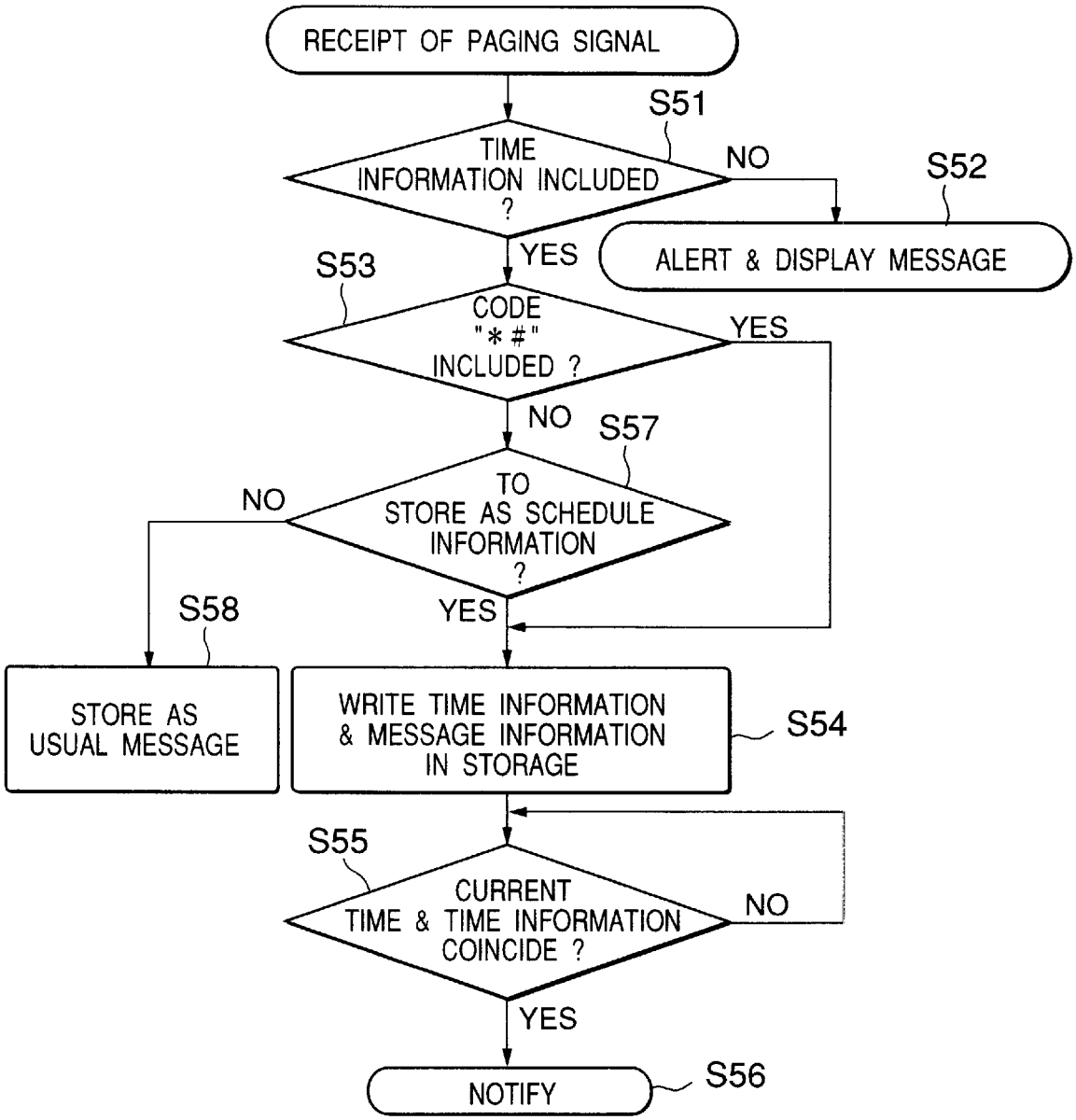
FIG. 3 is a flowchart demonstrating a specific scheduler routine particular to the embodiment.

A specific scheduler routine to be executed by the controller 40 will be described with reference to FIG. 3. As shown, on the receipt of a paging signal meant for the receiver, the controller 40 determines whether or not the paging signal includes time information (step S51). If the answer of the step S51 is negative (No), the controller 40 analyzes a message signal following an address signal and causes it to appear on the display 27 (step S52). If the answer of the step S51 is positive (Yes), the controller 40 causes the scheduler input request code detection 42 to see if the received paging signal includes the particular code "*#" or not (step S53).

When the detection 42 has detected the code "*#" (Yes, step S53), the controller 40 writes the time information and message information in the time and message storage 28 (step S54). Subsequently, the controller 40 compares the stored time information with the current time being counted by the time counter(step S55). When the current time coincides with the stored time information (Yes, step S55), the controller 40 reads the time information and message information out of the storage 28 and causes them to appear on the display 27 while performing a reporting operation.

When the paging signal does not include the code "*#" (No, step S53), the controller 40 determines whether or not the user desires to store the time information and message information as scheduler information (step S57). If the answer of the step S57 is Yes, the controller 40 causes the scheduler input decision control 43 to display a message for urging the user to decide whether or not the time information and message information should be written to the storage 28 as scheduler information (step S54), and whether or not the stored information should be displayed on the date and hour indicated by the time information (steps S55 and S56).

More specifically, assume that the user decides to store the time information and message information in the storage 28 as scheduler information, so that the user can be informed of those information on the date and hour designated by the time information (Yes, step S57). Then, the user operates the key 30 in order to store the time information and message information in the storage 28 (step S54). When the current time being counted by the time counter coincides with the stored time information (Yes, step S55), the controller 40 reads the time information and message information out of the storage 28 and causes them to appear on the display 27 while performing an alerting operation. On the other hand, if the user does not desire to store the time information and message information in the storage 28 (No, step S57), the controller 40 writes the information as usual message information and causes them to appear on the display (step S58).

FIG. 4 shows a specific data format including the particular code "*#", time information, and message information. As shown, assume that a calling person sends the particular code "*#", time information "01-31-15-00" and message information "Meeting" to the receiver. Then, the receiver automatically writes the time information and message information in the storage 28 and displays the message "Meeting" later at 15.00 of January 32 as designated by the time information.

Assume that the calling person sends the above time information "01-31-15-00" and message information "Meeting" without attaching the code "*#". Then, the controller 40 urges, via the display 27, the user of the receiver to decide whether or not to store the time information and message information in the storage 28 as scheduler information and whether or not to cause them to appear on the date and hour designated by the time information. In this manner, the illustrative embodiment allows a calling person to request the user of the receiver to input scheduler information in a scheduler, depending on the degree of importance of the information. In addition, the embodiment allows the user of the receiver to determine whether or not to input the received information in the scheduler.

FIGS. 5 and 6 each shows particular time information and message information which may appear on the display 27. As shown in FIG. 5, when the receiver receives the time information and message information not accompanied by the code "*#", the controller 40 displays a message for urging the user to decide whether or not the time information "01-31-15-00" and message information "Meeting" should be written to the storage 28, and whether or not the message information should appear on the display 27 at 15.00 of January 31 as designated by the date and time information. On the other hand, when the user, watching the display shown in FIG. 5, selects "YES" or when the receiver receives the code "*#" together with the above information, the controller 40 automatically displays "Meeting" at 15.00 of Jan. 31, as shown in FIG. 6.

It should be noted that the code "*#" used in the illustrative embodiment may be replaced with any other suitable code so long as it is distinguishable from time information and message information.

In summary, in accordance with the present invention, a radio selective calling receiver includes a controller capable of automatically storing, when a paging signal includes a particular code, time information and message information in a storage or urging, when the particular code is absent, the user of the receiver to decide whether or not the received time information and message information should be written to the storage and whether or not they should be displayed on the date and hour designated by the time information. The receiver therefore allows the user to determine whether or not the time information and message information should be automatically input to a scheduler, depending on the degree of importance of the received information. This promotes the efficient use of the storage assigned to messages.

The controller includes scheduler input request code detecting means for detecting the particular code out of the paging signal. With the detecting means, the controller is capable of surely performing the input of the scheduler input request code and detection within itself.

When the receiver receives the time information and message information without the particular code, and if the user decides that such information should not be written to the storage as scheduler information, the controller stores the information as a usual message signal. In this case, the message information does not have to be displayed on the date and hour designated by the time information, so that the efficient use of the storage is further enhanced.

Assume that a calling person sends a paging signal including time information and message information to the receiver. Then, depending on whether or not the paging signal additionally includes the particular code, the receiver automatically writes the received information in the storage and displays them on the date and hour indicated by the time information, or urges the user to decide whether or no the received information should be written to the storage. Therefore, the receiver is capable of displaying a message immediately or displaying it precisely on the date and hour designated by a calling person with a simple circuit arrangement.

While the invention has been described with reference to a specific embodiment thereof, it will be appreciated by those skilled in the art that numerous variations, modifications, and embodiments are possible, and accordingly, all such variations, modifications and embodiments are to be regarded as being in the spirit and scope of the invention.

What is claimed is:

1. A radio selective calling receiver, comprising:

searching means for determining whether a received paging signal includes time data;

storing means for storing schedule data that includes the time data and a message received therewith;

comparing means for comparing a current time with the stored time data;

display means for displaying the schedule data in response to a comparison in said comparing means; and control means for determining whether the paging signal includes a predetermined code, and if the predetermined code is found and if said searching means determines that the paging signal includes the time data, directing storage of the schedule data in said storing means, and if the predetermined code is not found and if said searching means determines that the paging signal includes the time data, directing said display means to display a query asking whether the schedule data is to be stored in said storing means.

2. A method of operating a radio selective calling receiver, comprising the steps of:

determining whether a received paging signal includes a predetermined code and time data;

directing storage in the selective calling receiver of schedule data that includes the time data and a message received therewith if the predetermined code is found and if the paging signal includes the time data; and displaying a query asking whether the schedule data is to be stored in the selective calling receiver if the predetermined code is not found and if the paging signal includes the time data.

3. The method of claim 2, further comprising the steps of comparing a current time with the stored time data, and displaying the schedule data if the current time matches the stored time data.

* * * * *